US007752952B1

(12) United States Patent
Hohil et al.

(10) Patent No.: US 7,752,952 B1
(45) Date of Patent: Jul. 13, 2010

(54) DYNAMIC BARRIER SYSTEM

(75) Inventors: Myron Hohil, Montville, NJ (US); Victor N. Kokodis, Wharton, NJ (US); Mark Mellini, Denville, NJ (US); Brian Peltzer, Fair Lawn, NJ (US); Anthony Sebasto, Budd Lake, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 474 days.

(21) Appl. No.: 11/308,288

(22) Filed: Mar. 15, 2006

Related U.S. Application Data

(60) Provisional application No. 60/594,239, filed on Mar. 22, 2005.

(51) Int. Cl.
*B64D 1/04* (2006.01)

(52) U.S. Cl. ..... 89/1.11; 89/1.819; 102/426; 102/427

(58) Field of Classification Search ..... 89/1.11; 102/426, 427
See application file for complete search history.

(56) References Cited

U.S. PATENT DOCUMENTS

| | | | | |
|---|---|---|---|---|
| 3,885,501 | A * | 5/1975 | Schneider, Jr. | 102/218 |
| 5,020,411 | A * | 6/1991 | Rowan | 89/1.11 |
| 5,415,103 | A * | 5/1995 | Radermacher | 102/427 |
| 5,497,705 | A * | 3/1996 | Bredy et al. | 102/427 |
| 6,739,547 | B2 * | 5/2004 | Redano | 244/3.14 |
| 6,896,220 | B2 * | 5/2005 | McKendree et al. | 244/3.15 |
| 7,047,861 | B2 * | 5/2006 | Solomon | 89/1.11 |
| 7,367,525 | B2 * | 5/2008 | McKendree et al. | 244/3.15 |
| 2003/0051597 | A1 * | 3/2003 | O'Dwyer | 89/1.11 |
| 2003/0126977 | A1 * | 7/2003 | Garcia et al. | 89/1.11 |
| 2003/0132746 | A1 * | 7/2003 | Cox | 324/207.26 |
| 2003/0136290 | A1 * | 7/2003 | Kolbli | 102/210 |
| 2003/0159572 | A1 * | 8/2003 | Downs, Jr. | 89/1.11 |
| 2004/0237762 | A1 * | 12/2004 | O'Dwyer | 89/1.11 |
| 2006/0169832 | A1 * | 8/2006 | Glasson | 244/3.1 |
| 2007/0244673 | A1 * | 10/2007 | Khosla et al. | 703/2 |
| 2008/0018522 | A1 * | 1/2008 | Redano | 342/62 |
| 2008/0148925 | A1 * | 6/2008 | O'Dwyer | 89/1.11 |
| 2008/0314234 | A1 * | 12/2008 | Boyd et al. | 89/1.11 |
| 2009/0000465 | A1 * | 1/2009 | Deflumere et al. | 89/1.11 |
| 2009/0223354 | A1 * | 9/2009 | Root, Jr. | 89/1.11 |

OTHER PUBLICATIONS

Brunnstrom, David, "US Bombs Still Kill, Maim in Laos after 20 Years—America should pay for cleanup, aid agencies say", Seattle Times, Aug. 12, 1993, p. A16.*

* cited by examiner

*Primary Examiner*—Troy Chambers
*Assistant Examiner*—Samir Abdosh
(74) *Attorney, Agent, or Firm*—Henry J. Goldfine

(57) ABSTRACT

A dynamic barrier system including a number of sensors that monitor a barrier area to determine specific types of objects approaching, within, or exiting the barrier area. Depending upon the type of object(s), the dynamic barrier system initiates an appropriate action, both lethal and non-lethal. The barrier system may advantageously deactivate after its intended period of operation eliminating difficult and/or dangerous removal.

14 Claims, 8 Drawing Sheets

312

DYNAMIC BARRIER SYSTEM

CROSS REFERENCE TO RELATED APPLICATION

This application claims the benefit under 35 USC 119(e) of U.S. Provisional Patent Application No. 60/594,239 filed Mar. 15, 2005, the entire file wrapper contents of which provisional application are herein incorporated by reference as though set forth at length.

FEDERAL RESEARCH STATEMENT

The invention described herein may be made, used, or licensed by or for the United States Government for government purposes without payment of any royalties thereon or therefore.

FIELD OF THE INVENTION

This invention relates generally to the field of barrier systems, and in particular to a dynamic barrier system that monitors an area, senses and determines specific types of objects within that area, and actively/dynamically reacts to those objects.

BACKGROUND OF THE INVENTION

For centuries, barrier systems of various types have been employed to impede or prevent the infiltration of undesirables into an area. From the earliest moats and high castle walls, to present day mine fields, barrier systems have provided impediments to infiltration.

Yet while such historic barrier systems have achieved successes in preventing the infiltration of adversaries, they unfortunately do not discriminate and consequently may serve to inhibit both friend and foe alike. In addition, certain barrier systems such as mine fields remain active indefinitely, or at least until they are removed and/or deactivated—a task that is both dangerous and prohibitively time consuming.

Consequently, barrier systems that inhibit foes while permitting friends and which do not require dangerous deactivation and/or removal would represent a significant advance in the art.

SUMMARY OF THE INVENTION

We have developed, in accordance with the principles of the invention, a dynamic barrier system that is selective, i.e., able to engage a credible threat and initiating appropriate action. Viewed from a first aspect, our inventive barrier system includes a series of sensors that monitor a barrier area to determine specific types of objects approaching, within, or exiting the barrier area. Depending upon the type of object(s), our dynamic barrier system initiates an appropriate action.

Viewed from another aspect, our inventive barrier system responds to the type of object(s) sensed in the barrier area with appropriate force(s) for example, lethal or non-lethal. Accordingly, our inventive barrier system may permit the presence or passage of authorized objects (i.e., friendly forces) by not attacking or de-activating certain components of the barrier system, or alternatively, instituting an attack against unauthorized objects (i.e., unfriendly forces) so sensed in the barrier area.

In this inventive manner, our inventive barrier system may be emplaced and then provide a form of self-protection whereby it senses an object, determines its type, and responds appropriately.

Viewed from yet another aspect, our inventive barrier system advantageously deploys munition components only when needed. As a result, barrier areas are not made particularly hazardous until needed, and munitions are not wasted. As a further aspect, our inventive barrier system does not persist in the barrier area after its intended period of operation. In this inventive manner, difficult and/or dangerous removal is not required of our system.

BRIEF DESCRIPTION OF THE DRAWING

A more complete understanding of the present invention may be realized by reference to the accompanying drawing in which.

DETAILED DESCRIPTION OF THE PREFERRED EMBODIMENT

Figure 1:
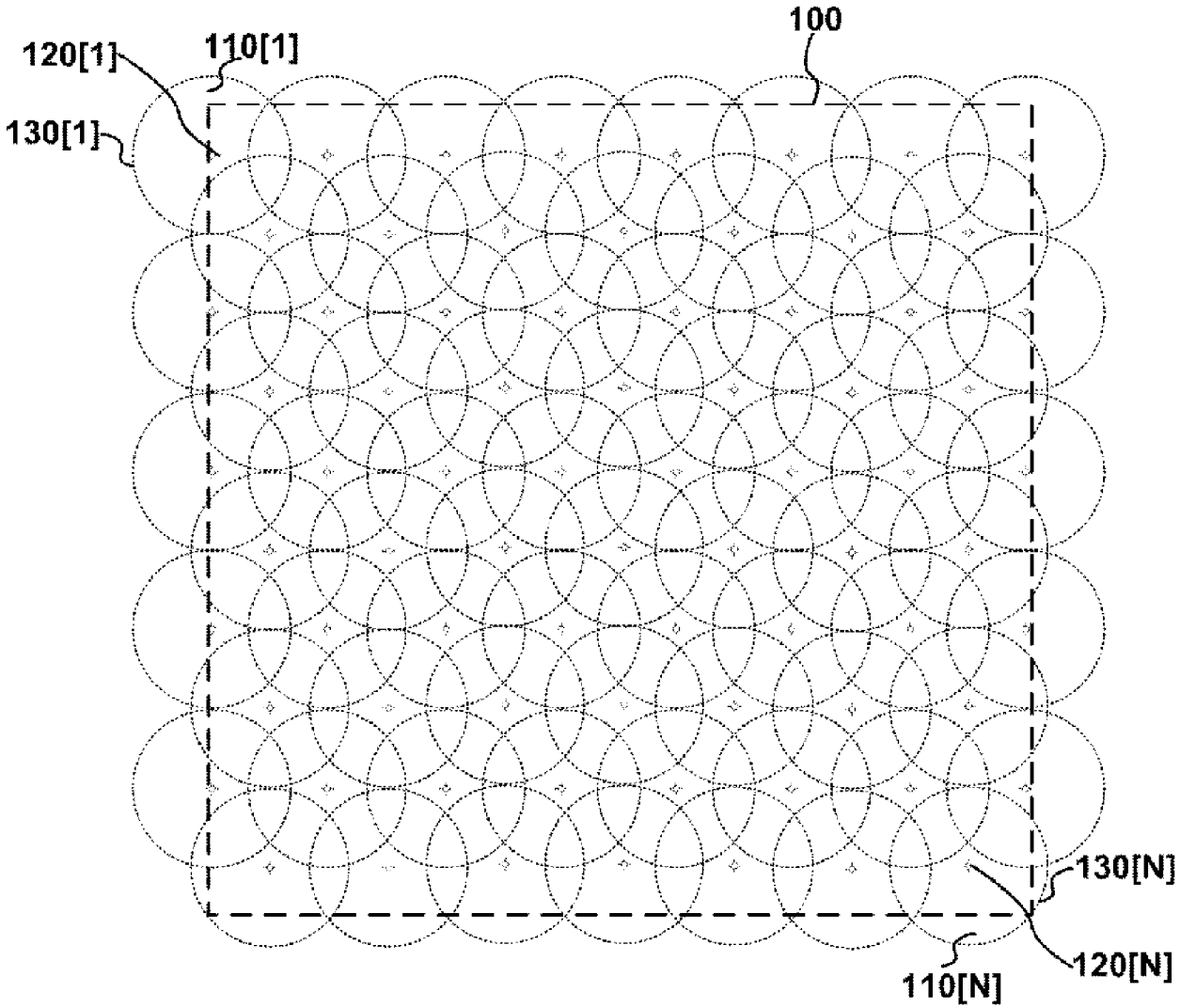
FIG. 1 is a schematic illustration of an exemplary barrier area/system in which a number of sensors are placed according to the present invention.

FIG. 1 is a schematic illustration of a barrier area that will serve as a starting point for a discussion of the present invention. In particular, and with reference to that FIG. 1, there is shown a barrier area 100 having a plurality of barrier sensor systems 120[1] . . . 120[N] situated therein. Each of the individual barrier sensor systems 120[1] . . . 120[N] monitors a respective barrier sensory field 110[1] . . . 110[N], each individual field being defined by a barrier sensory field perimeter 130[1] . . . 130 [N], respectively.

At this point it is worth noting that the barrier area 100 depicted in FIG. 1 is a particular area over which our inventive barrier system is operating. The barrier sensor systems 120[1] . . . 120[N] deployed within the barrier area 100 each comprise at least one particular type of sensor. Each individual barrier sensory field 110[1] . . . 110[N] may be associated with situational awareness, anti-personnel effects, anti-vehicle effects, or non-lethal effects, or any combination thereof.

The sensor systems 120[1] . . . 120[N] may be delivered to the barrier area 100 by a variety of methods including aerial deployment, unmanned aerial deployment and/or unmanned vehicle deployment or a combination thereof. As we will later describe, the sensor systems may advantageously deployed as part of projectile payload(s).

With continued reference to FIG. 1, the barrier sensory areas 110[1] . . . 110[N] are shown overlapping their respective adjacent barrier sensory areas. While such an arrangement is not essential to the operation of a barrier system or a barrier system constructed according to the present invention, overlapping the sensory areas in this manner ensures that the entire barrier area 100 is sensed by one or more individual sensor systems and that there are no "blind" areas within the barrier area 100. Consequently, an object located anywhere within the barrier area 100, that is the focus of a sensory activity (not specifically shown in the FIG. 1, and hereinafter referred to as a "target"), may possibly be sensed by one or more of the barrier sensor systems 120[1] . . . 120[N].

At this point it is important to note that the exemplary barrier area 100 shown in this FIG. 1 is not shown as specific to a particular type of environment or terrain i.e., urban or rural, flat or hilly. Accordingly, and as will become readily apparent to those skilled in the art, our inventive system may be employed in any or all of the above-mentioned areas, environments or terrain, as well as others.

Advantageously, when multiple barrier sensor systems are arranged in a manner like that shown in FIG. 1, even if a target moves within the barrier area 100, it will be sensed by other subsequent barrier sensor systems when that target is located within their respective barrier sensory area(s). Additionally, when a target is sensed by multiple barrier sensor systems—because it is situated within overlapped barrier sensory areas of multiple barrier sensor systems—the reliability of the sensed data may be improved as multiple, independent barrier sensor systems provide their independent sensory data.

Importantly, while FIG. 1 illustrates only a single barrier sensor system (i.e., 120[1]) within a particular sensory field (i.e., 110[1]), it should be understood and appreciated by those skilled in the art that multiple barrier sensor systems may occupy a single barrier sensory area. Consequently, and according to one important aspect of the present invention—the multiple barrier sensor systems need not even be responsive to the same sensory stimulus.

For example, a given barrier sensory field may have barrier sensor systems responsive to E-Field, B-Field (Magnetometers), acoustic, electromagnetic, vibrational, chemical, visual or non-visual stimulus, or a combination thereof. In this manner, a target that did not produce, for example, an audible signature may nevertheless produce a vibrational signature, capable of being detected by a vibrational barrier sensor system. Still further—and according to the present invention—when dissimilar barrier sensor systems or sets of barrier sensor systems (i.e., E-Field, B-Field and/or Acoustic) detect a particular object—it becomes possible to determine more precisely what type of object is being detected.

In particular quasi-static electricity generated by passing individuals and/or vehicles generate temporal perturbation(s) in the geoelectric field. These perturbations, while small, may be measured using small, highly sensitive E-Field barrier sensors.

Of further importance, geoelectric field perturbations caused by persons (both with and without magnetic materials) and vehicles exhibit very different, detectable, and consequently recognizable differences in E-Field signatures. As a result, using B-Field sensors (magnetometers) in addition to the E-Field barrier sensors mentioned, it is possible to make simultaneous measurement of geomagnetic field perturbations due to persons both with and without magnetic materials passing within an effective barrier area of our barrier sensor(s).

At this point it is essential to note that while we have so far limited the discussion of our combined barrier sensor systems to those only including E-Field and B-Field barrier sensor(s), our invention is not so limited. More specifically, by including acoustic barrier sensor(s) (and others) along with the E-Field and B-Field barrier sensors, more flexible, and accurate determinations may be made.

In fact, individual sensor systems may comprise multiple sensors, each capable of sensing individual stimuli. Normally, such sensor(s) will not contain any lethal or otherwise intentionally harmful payload. Instead, such payload(s) may be provided by another DBS component, i.e., a UGV which may have been the same UGV that deployed the particular sensor. In this manner the sensor(s) that are deployed in a barrier area pose no residual threat and their removal is not particularly hazardous. Of course, sensor(s) systems that are potentially harmful/lethal may be deployed with their harmful/lethal aspects being remotely enabled/disabled from, for example, a UGV. Such systems are certainly within the scope of our inventive teachings.

As is known, acoustic sensors and accompanying algorithm(s) have been developed by the art to detect vehicles powered by internal combustion engines. Consequently, such acoustic sensors, when used in combination with the E-Field and B-Field barrier sensors described, may comprise a comprehensive barrier sensory system which—when combined with data fusion method(s)—can provide a barrier system with the ability to discriminate among various object types that are detected within a particular barrier area.

Figure 2A:
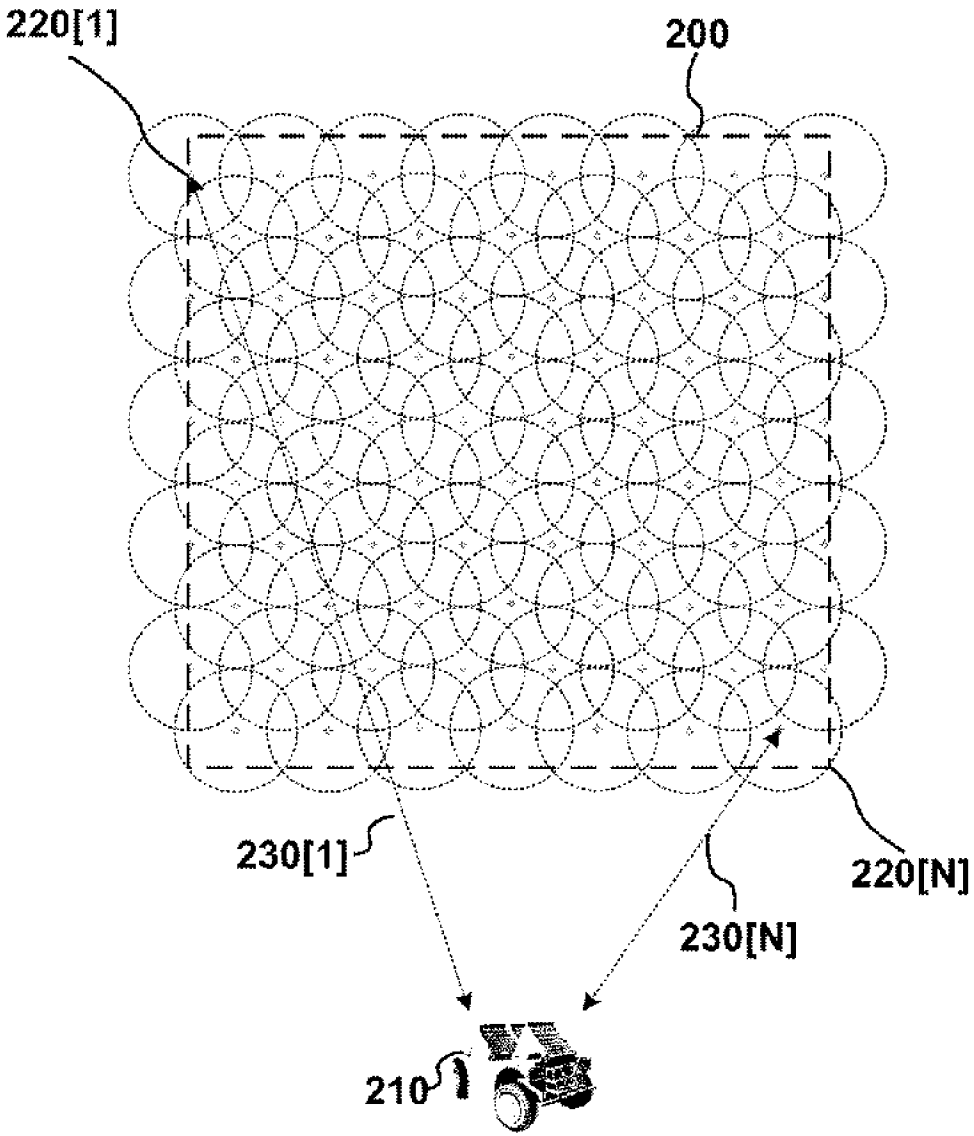
FIG. 2*a* is a schematic illustration of an exemplary barrier area/system in which a number of sensors are placed along with an unmanned robotic vehicle according to the present invention.

Returning now to our discussion of our inventive dynamic barrier system and in particular with reference to FIG. 2*a*, there is shown a barrier system 200 such as that shown in FIG. 1 including a number of barrier sensors 220[1] . . . 220[N].

In this exemplary barrier system, each of the individual barrier sensor systems 220[1] . . . 220[N] is shown in communication with barrier system unmanned ground vehicle (UGV) 210 via individual sensor communications links 230[1] . . . 230[N], respectively. As used in this example, the UGV 210 is a motorized, unmanned vehicle which is deployed into an area and optionally deploys one or more barrier sensor(s) and subsequently receives barrier sensor data transmitted from those sensors—or others deployed via separate deployment systems described previously, i.e., aerial vehicles, aerial unmanned vehicles or other ground vehicles—both manned and unmanned.

In one embodiment, the UGV 210 may employ METAL STORM® pod capable of deploying both sensors and munitions. METAL STORM technology is an electronically initiated, stacked projectile system that eliminates the mechanisms required to fire a conventional weapon. Effectively, the only parts that move in a METAL STORM pod are the projectiles contained within individual barrels comprising the pod. Multiple projectiles are stacked within the barrels. As a result, each projectile may be fired sequentially fired from an individual barrel, with multiple barrels being fired simultaneously.

As a result, METAL STORM barrels are individual weapons, without traditional ammunition feed or ejection system, breech opening or any other moving part (other than the vehicle carrying the pod and the pod itself). METAL STORM barrels may be grouped in multiple configurations to meet a diversity of applications. Each individual projectile stacked in a barrel includes its own propellant load, such that a leading propellant may fire its projectile, without resulting in an unplanned ignition of propellant of following projectile(s). As a result, such systems may advantageously deploy a wide variety of projectile(s), including sensory projectiles (for deployment) or munition projectiles that may attack a target with both lethal or non-lethal force as appropriate.

Returning our discussion to FIG. 2*a*, it should be noted that for the sake of clarity, not all of the individual communications links are shown in the FIG. 2*a*. Nevertheless, it is understood that one or more individual communications link(s) exist from an individual sensor system to the UGV 210.

Further, such communications link(s) may be any one or a mix of known types. In particular, while surveillance systems such as those described herein are particularly well-suited (or even best suited) to wireless communications link(s), a given surveillance application may be used in conjunction with wired, or optical communications link(s). Advantageously, the present invention is compatible with all such links. As we noted prior, not all of the individual communications links are shown in the FIG. 2*a*, and in particular, no peer-to-peer links are shown. Nevertheless, it is understood that a communications link exists from an individual sensor system to a control system either directly, or via peer-to-peer mechanisms.

Speaking topologically, our inventive method and systems may operate over a "star" or "peer-to-peer" topologies. Such topologies, will be determined largely by the specific deployment needs. And while our discussion herein has been limited for the sake of simplicity to that of a star, the peer-to-peer topology differs from the star in that any node can communicate with any other node as long as they are within radio range of one another. Peer-to-peer topologies allow more complex network formations to be implemented, such as mesh topologies. Advantageously, peer-to-peer networks formed according to our inventive teachings may be ad hoc, self-organizing and self-healing. Furthermore, multiple hops to route communications messages from a particular sensor node(s) to any other node(s) or gateway(s) within the network are possible and foreseen.

We note that the UGV 210 is shown as the recipient of the sensory data sensed at each of the barrier sensors 210[1] . . . 210[N]. While not specifically shown in this FIG. 2*a*, the sensor data is received at the UGV 210 by a control station which, as used in this example is contained within the UGV 210. Importantly, and as we shall discuss a bit later, the control station may be located anywhere within a real-time communications distance. Consequently, it may be located within a UGV 210, such as that shown, another UGV (not specifically shown), another battlefield system (not specifically shown) or a command center situated remotely from the barrier area.

The function of a control station is to receive sensor data (which may be target information), optionally fuse them into barrier area information, and enable/initiate an appropriate response including, automated deployment of munitions, and/or disabling munitions. As can be now appreciated, when an object is detected by one or more individual sensors within a barrier area, its sensor data is used to determine the type of object (i.e., friend or foe, tank or platoon) and from this information an appropriate response is initiated. When that response is initiated by, for example, an UGV, it is advantageously in very close proximity to the particular object(s) sensed and identified, and therefore is likely to be most effective.

Of course, barrier system applications generally require flexibility, distributed across a wide geography including various terrain(s) and topographies as noted before. As such, wireless methods are preferably used and receive the most benefits from the employment of the present invention. Of particular importance to these wireless systems, is the very high transmission compression rates afforded, thereby allowing the maximum amount of data transmitted in a minimal amount of time. Such benefit(s), as will become much more apparent to the reader, facilitate scalability as additional wireless barrier sensor systems may be incrementally added to an existing barrier area as requirements dictate, and because barrier sensory systems do not have to transmit for extended periods of time, power consumption is reduced and delectability (by unfriendly entities) of the barrier sensor systems themselves is reduced.

The UGV 210/control system receives data streams transmitted from each of the barrier sensor systems situated within the barrier area 200. As can be appreciated by those skilled in the art, since the surveillance area 200 may include scores (or more) of barrier sensor systems, UGV 210/control system must be capable of receiving data streams in real time from such a large number of barrier sensor systems. In the situation where different types of communications links are used between UGV 210/control system and individual barrier sensor(s) systems, the UGV 210 must accommodate the different type of communications link or additional UGVs (not specifically shown) which do support the different communications link(s) may be used in conjunction with UGV 210.

According to the present invention, UGV 210/control system receives data from one or more barrier sensors 220[1] . . . 220[N] positioned within the barrier area 200 and further processes the received data thereby deriving further informational value. As can be appreciated, the data contributed from multiple sensor systems within the barrier area 200, may be "fused" such that this further informational value may be determined. When this data fusion involves the E-Field, B-Field, Acoustic and/or other sensors described previously, the result is a determination of the specific type of object(s) detected within the barrier area at a given time and permits the UGV 210 to initiate an appropriate response.

Figure 2B:
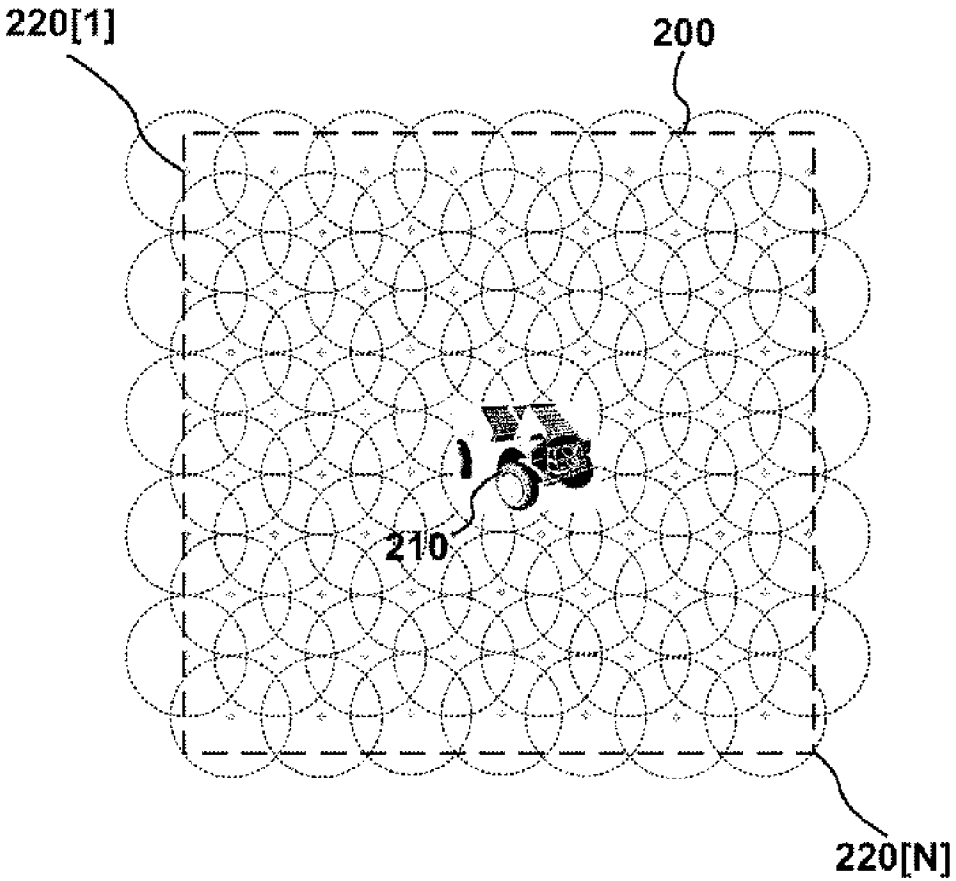
FIG. 2*b* is a schematic illustration of an exemplary barrier area/system layout in which the robotic vehicle is placed within the sensor field according to the present invention.

Before describing the response(s) initiated however, we reference FIG. 2*b* which, while similar to that shown in FIG. 2*a*, depicts a UGV 210 physically situated within a barrier area 200. In a situation such as that depicted in this FIG. 2*b* The UGV 210 is "rolled" or driven or otherwise positioned within the barrier area 200 and then begins communicating with the barrier sensor systems 220[1] . . . 220[N]. Upon receipt of data indicative of a situation requiring action, the UGV may, for example launch or direct an attack.

Figure 2C:
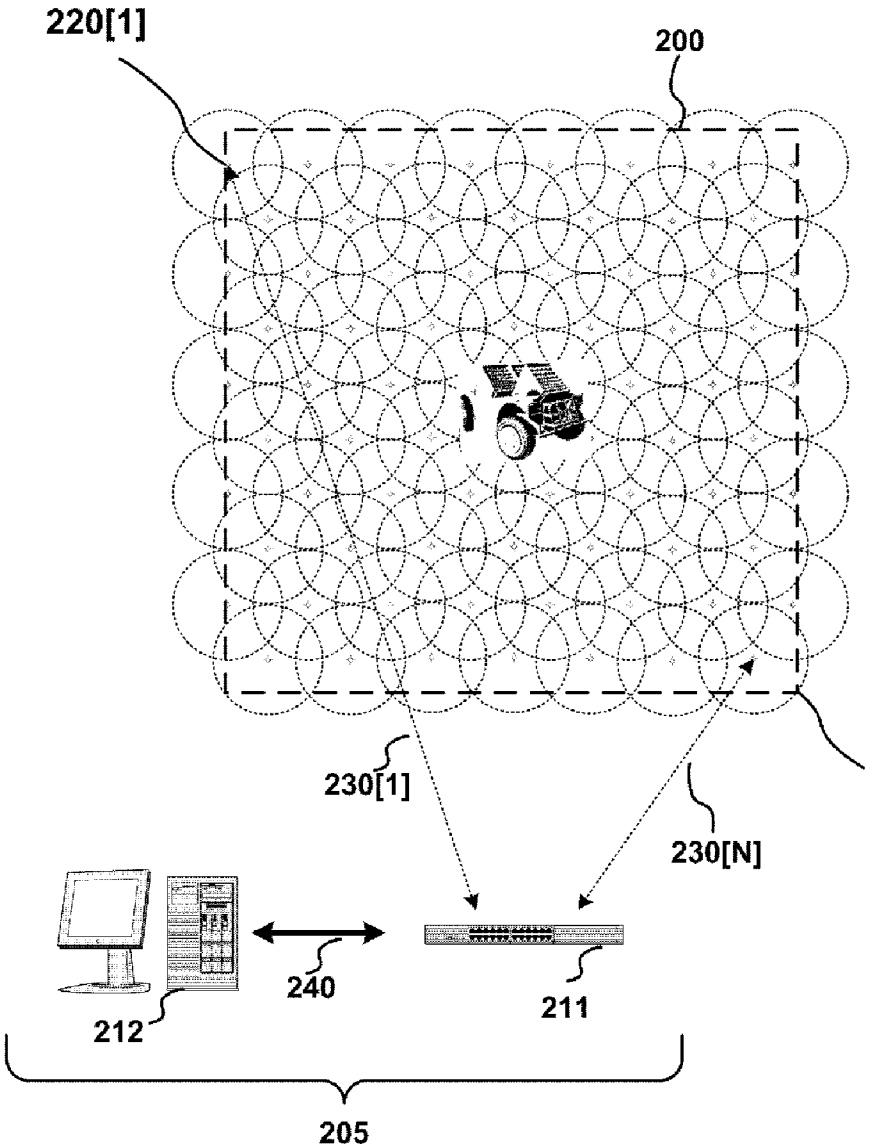
FIG. 2*c* is a schematic illustration of an exemplary barrier area/system layout showing the relationship(s) between the barrier sensors and control systems.

With reference now to FIG. 2*c*, there is shown a dynamic barrier area 200 similar to that shown in FIGS. 2*a* and 2*b*, showing the communications/computational control system 205. As we have noted earlier, the control system may be located within a UGV or elsewhere, as depicted in this FIG. 2*c*.

Specifically shown in this FIG. 2*c* is communications gateway 211 provides a convenient mechanism by which to receive data streams transmitted from each of the sensor nodes situated within the surveillance area 200. As can be appreciated by those skilled in the art, since the surveillance area 200 may include a number of individual sensor nodes, the communications gateway 211 must be capable of receiving data streams in real time from such a large number of sensor nodes. In addition, in certain situations it may be desirable to have multiple communications gateways operate within a specific surveillance area to serve as backup or alternatively, to provide additional uplink bandwidth from the plurality of sensor nodes deployed.

As a further note, and as will be described in more detail later, the communications links 230[1] . . . 230 [N] are preferably bi-directional such that configuration/command/control information may be provided to an individual sensor node from the master processing system 212. Typically, the uplink (master processing system to sensor node) need be of lower bandwidth than the downlink, as the volume of data sent in the uplink direction is usually much less.

As depicted in the FIG. 2*c*, the master communication link 240 provides a bi-directional communications path(s)

between the master processing system 212 and the communications gateway 311. Data received by the communications gateway 311 via communications links 230[1] . . . 230[N] are communicated further to the master processing system 212 via the master communications link 240. Necessarily, the master communications link 240 in the downlink direction is of sufficient bandwidth to accommodate the aggregate traffic received by communications gateway 211. Similarly, the uplink bandwidth of the master communications link 240—while typically much less than the downlink bandwidth—must support any uplink communications from the master processing system 212 to the plurality of sensor systems situated in the surveillance area 200. It is readily anticipated that a deployment may comprise, in addition to a plurality of sensors, a number of communications gateways 211, as well.

At this point it should be apparent to those skilled in the art that the communication/computational control system 205 may advantageously be deployed within a barrier area, nearby a barrier area or remote to a barrier area. With our inventive architecture and arrangement(s), the systems comprising the control systems may be positioned in locations dictated by the circumstances and specific application.

According to the present invention, master processing system 212 receives data from one or more sensors nodes 220[1] . . . 220[N] positioned within the surveillance area 200 and further processes the received data thereby deriving further informational value. As can be appreciated, the data contributed from multiple sensor nodes with the surveillance area 200 permits the operation of powerful "sparse arrays" of sensor systems, exhibiting much higher detection/classification/identification/tracking potential than existing systems.

In a preferred embodiment, and according to the present invention, the master processing system 212 offers equivalent functions of present-day, commercial computing systems. Consequently, the master processing system 212 exhibits the ability to be readily re-programmed, thereby facilitating the development of new data fusion methods/algorithms and/or expert systems to further exploit the enhanced data fusion potential of the present invention.

Figure 3A:
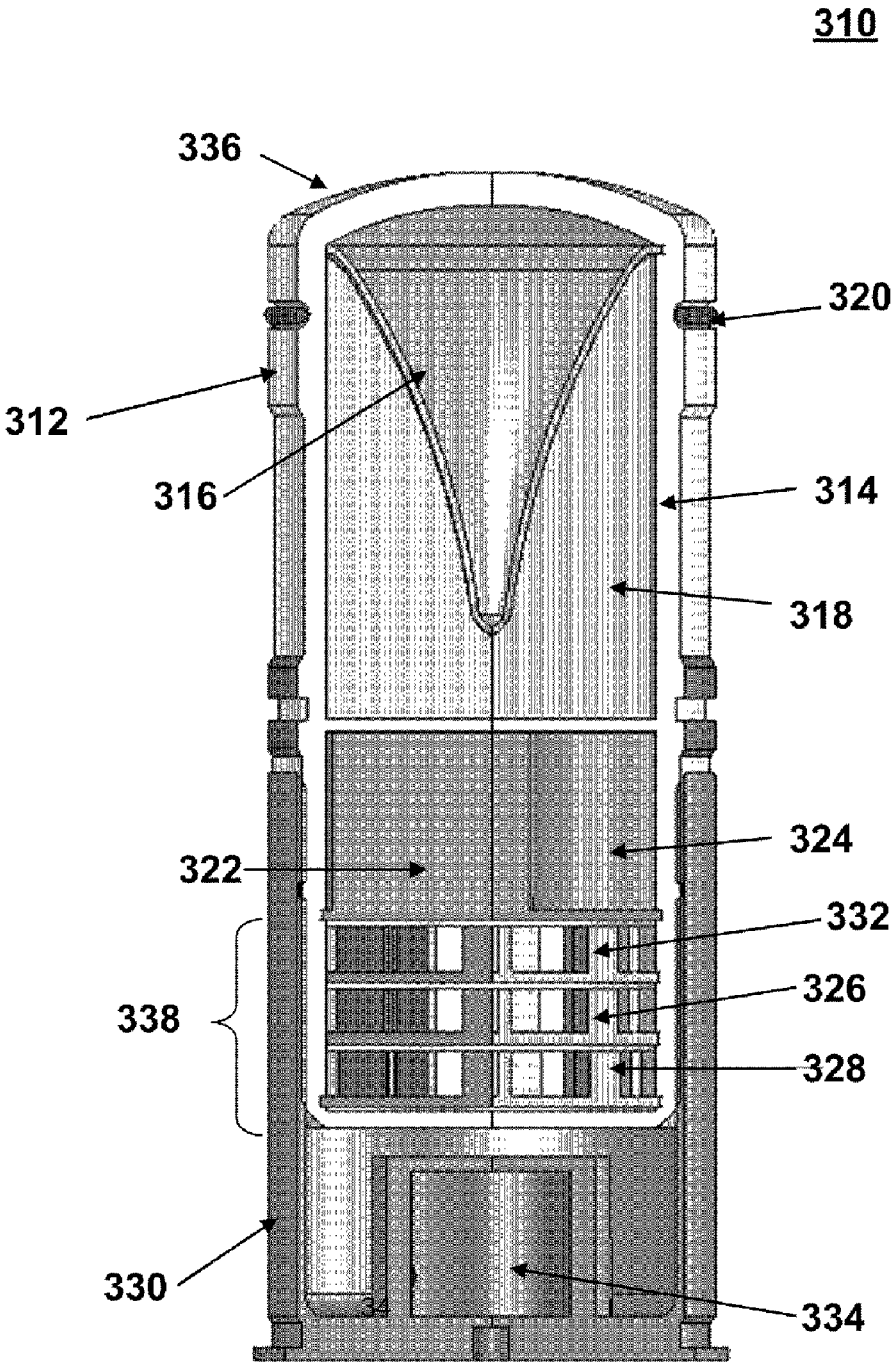
FIG. 3*a* is a schematic illustration of a dual purpose munition for use in a barrier system according to the present invention.

Advantageously, our inventive dynamic barrier system may employ a variety of sensors and/or munitions. One such munition, a dual purpose munition (DPM) is shown in FIG. 3*a*. The DPM 310 shown in FIG. 3*a* may be realized in the form of a 40 mm grenade, although other sizes are within the scope of the invention. The 40 mm size allows the emplacement of the DPM 310 with a METALSTORM dispenser system as part of the Dynamic Barrier System (DBS)—thereby providing a lethal reaction force to appropriate sensed/identified objects. The small, hardened configuration allows it to be emplaced on an as-needed basis using the METALSTORM dispenser thereby providing a temporary, and nearly instantaneous barrier where needed.

It is important to note at this point that the METALSTORM dispenser is but one means of emplacement. Accordingly, other emplacement systems/methods could be effectively utilized with our inventive dynamic barrier system and in preferred embodiments, such systems/methods would provide the remote emplacement whereby the munitions are delivered from a safe distance as needed. In this inventive manner, the sensing and attack or lethal aspects of the munitions are separable.

The DPM 310 as shown in FIG. 3*a* advantageously provides two modalities, anti-tank/anti-vehicle and anti-personnel. The two modalities improve logistics by not requiring two separate munition types.

As shown, the DPM 310 has a vertically orienting warhead to improve its performance against vehicles. This ability to engage a threatening vehicle from underneath improves its ability to disable the vehicle with a relatively small warhead. The DPM 310 permits emplacement of a short term barrier in an area that a threat has been detected by pre-emplaced sensors comprising the dynamic barrier system.

As shown in FIG. 3*a* the DPM 310 includes a housing 312 having a front end 336; a shaped warhead 314 disposed in the front interior of the housing 312; a vertically orienting explosive 320 disposed on the front end 336 of the housing 312; a safe and arm device 322 explosively connected to the shaped warhead 314 for arming and detonating the shaped warhead 314; a dual sensor circuit 338 comprising an E-field sensor board 326, a B-field sensor board 328 and a processor board 332; and a power source 324 connected to the dual sensor circuit 338 and the safe and arm device 322.

In the embodiment shown in FIG. 3*a*, the DPM 310 is disposed in a shell casing 330 having a suitable propellant 334 situated in its base. When fired from a gun or tube, the shell casing 330 remains in the gun or tube while the DPM 310 is launched.

Figure 3B:
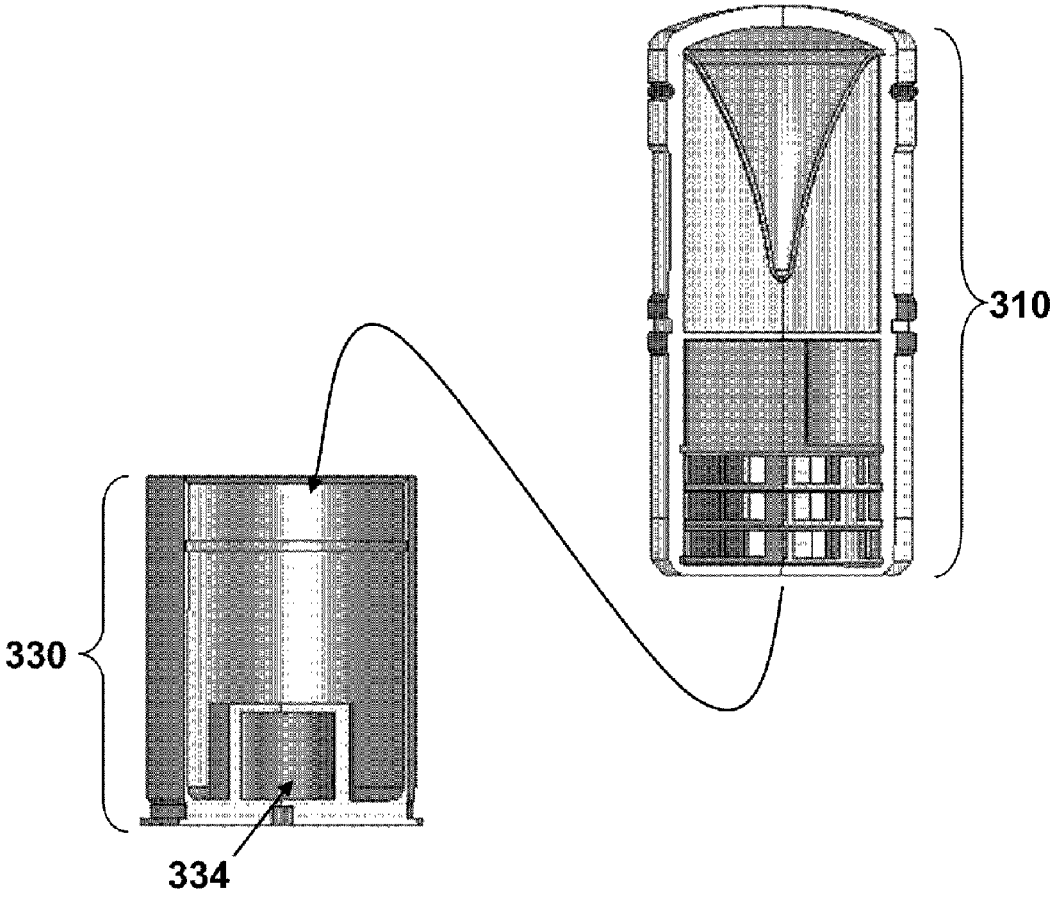
FIG. 3*b* is a schematic illustration of the dual purpose munition of FIG. 3*a* showing the charge/sensor system separated from the casing.

With reference now to FIG. 3*b*, there it shows the shell casing 330 and DPM 310 separated from one another. As can be readily appreciated by those skilled in the art, if the DPM 310 is air-dropped or manually placed, it could be so placed without the shell casing 330 and propellant 334.

A shaped warhead 314 is known in the art and generally comprises an explosive 318 formed behind a liner 316. A vertically orienting explosive 320 may comprise a ring of detonation cord that encircles the front end 336 of the housing 312.

The safe and arm device 322 is known and operates to arm the shaped warhead 314 contingent on one or more preconditions or combination of preconditions. Such preconditions may include, for example, set forward acceleration, setback acceleration, spin, centrifugal force, impact or time delay.

As used in our exemplary DPM 310, the dual sensor circuit 338 comprises a geoelectric field sensor (E-field sensor) board 326, a geomagnetic field sensor (B-field) board 328 and a processor board 332. As can be appreciated, quasi-static electricity generated by humans and vehicles causes a local temporal perturbation in the geoelectric field. These perturbations, although small, can be detected and measured using the E-Field sensor board 26. Geoelectric field perturbations caused by passing humans and vehicles have very different and easily recognizable structures.

The B-Field sensor board 328 measures the geomagnetic field perturbations due to passing humans and vehicles. The processor board 332 processes and data-fuses the outputs of the E-Field and B-Field sensor boards 326, 328 to detect and differentiate between a human and a vehicle (automobile, truck, armored personnel carrier, tank, etc.). An exemplary dual sensor circuit 338 is disclosed in U.S. provisional patent application Ser. No. 60/593,283 filed on Jan. 4, 2005, the entire contents of which is hereby incorporated by reference. An impact switch may be included in the dual sensor circuit 338 to start the E-field and B-field sensor boards 326, 328 upon impact of the munition 310.

The processor 332 combines signals from the E-field and B-field sensor boards 326, 328 to determine whether a target is personnel or a vehicle and, if the target is personnel, the safe and arm device 322 initiates the vertically orienting explosive 320 and then initiates the shaped warhead 314.

Figure 3C:
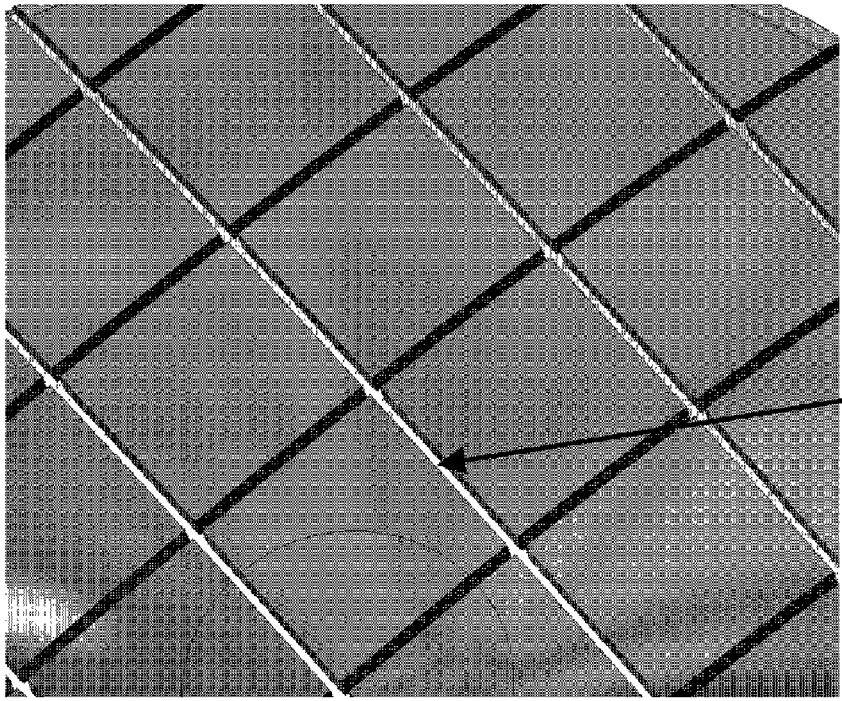
FIG. 3*c* is a micrograph illustration of the surface of the dual purpose munition for anti-personnel applications showing a series of scribe lines.

Of further interest, and as shown in FIG. 3*c*, the exterior surface of at least part of the housing 312 includes scoring 340 such that, upon detonation of the shaped warhead 314, the housing 312 creates fragments. Because the munition 310 has been vertically oriented prior to detonation of the shaped warhead 314, the fragments from the housing are dispersed in a 360 degree array. These fragments are lethal to personnel.

Alternatively if a target is a vehicle, the processor 332 determines from the B-field sensor board 328 when the vehicle is above the munition 310. The processor 332 monitors the change in the B-field reading. As the vehicle approaches the munition 310, the B-field reading rises until the centroid of the vehicle is reached. Once the centroid passes over the munition 310, the B-field signal begins to weaken. This change in the B-field signal is the trigger to vertically orient the munition 310 and then detonate the shaped warhead 314. Because the shaped warhead 314 is directly beneath the target vehicle, the munition 310 is especially lethal.

The safe and arm device 322 may include a timed self-destruct circuit that causes initiation of the shaped warhead 314 after an elapsed time. In this way, the barrier of munitions 310 has a predictable life span. The self-destruct circuit helps to eliminate the problem of unexploded ordnance on the battlefield. Alternatively, when equipped with appropriate communications circuitry, the device may be disabled electronically from a remote vehicle or system.

As described so far, the dual purpose munitions is a sensor fused grenade which can detect and distinguish between humans and vehicles and then engage with a dual purpose warhead. With the DPM, internal sensors are used to detect the target from a distance, without requiring physical contact. The onboard sensors enable the DPM to distinguish between personnel and vehicles, thus allowing a single version of the grenade to perform both functions. The sensors allow the DPM grenade to be emplaced at the desired location and linger until a target is detected or a preset time expires and the DPM self destructs. The DPMs create a barrier quickly and only when needed, thus eliminating the problem of having energetic devices in the battle field after the conflict has ended.

While those skilled in the art will quickly recognize that such a DPM as described may operate in a "stand-alone" mode or alternatively in a "network" mode. When operating as stand alone, the DPM is basically deployed and is left operating on its own. When part of a network, the multiple DPMs act as separate sensor systems, each capable of providing an important individual component of barrier area information.

By way of example, one or more DPMs, when used in conjunction with an array of field sensors such as those described previously, permit the accurate, real-time determination of a threat and permit rapid response. For example, if data received from a sensor or sensors indicated that not a single vehicle, but rather a convoy of vehicles was near, the DPM could detonate itself. In a networked mode, the other DBS component systems (i.e., UGV, for example) could launch a further attack on the convoy using what munitions it had at its disposal.

Figure 4:
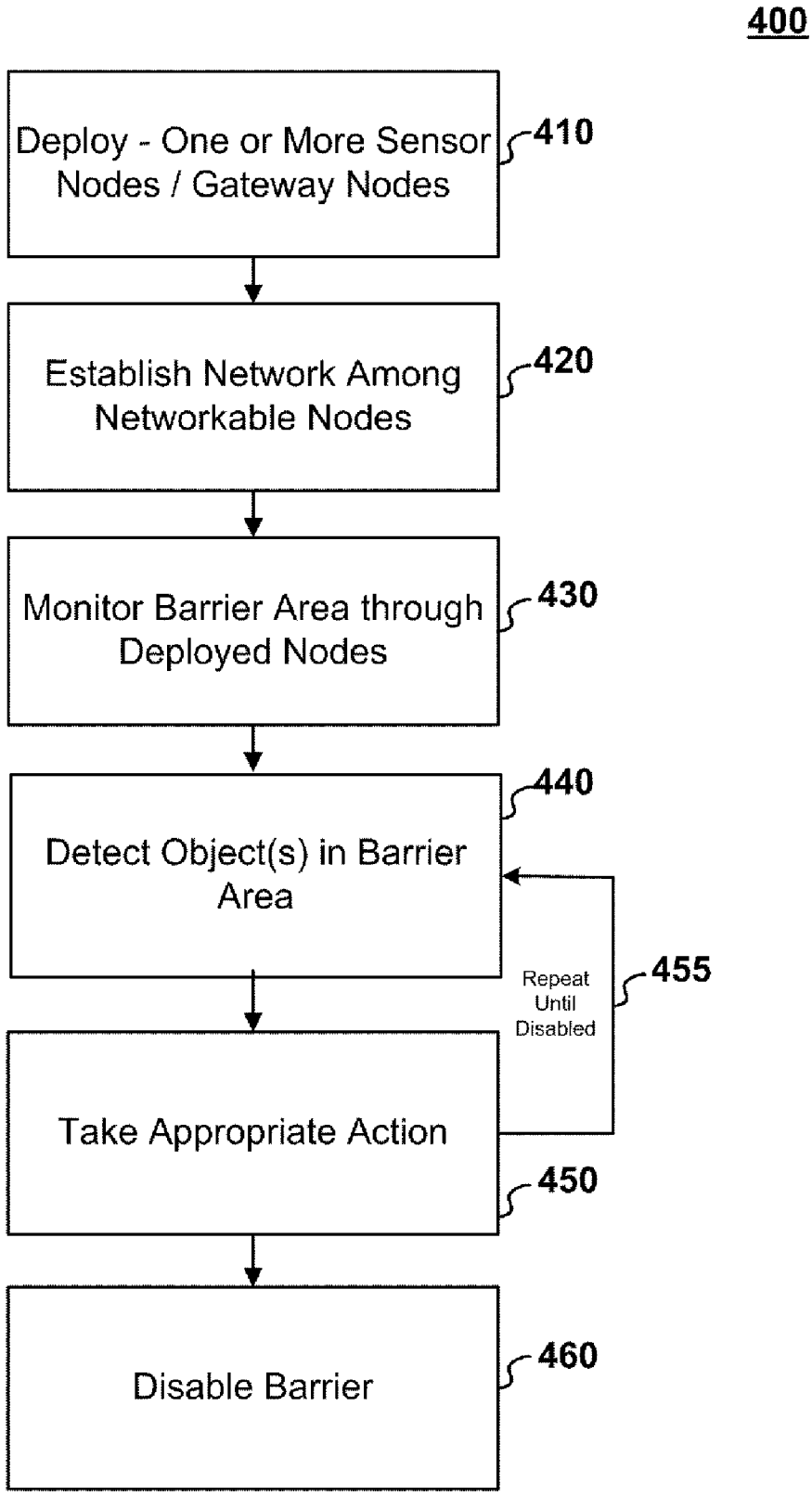
FIG. 4 is a flowchart depicting the steps associated with our inventive method.

Finally, we turn to FIG. 4 which shows a flowchart providing an overview of our inventive method. As depicted by block 410 one or more sensor nodes/gateway nodes are deployed within a barrier area. As noted before, the individual nodes may advantageously be deployed ballistically, dropped by air, or placed by hand or other means. Those items which are networkable, will establish a communications network, generally an ad-hoc wireless network, such that any data collected by individual nodes is processed together, and fused into higher-order information (block 420)

Once operational, the barrier area containing the deployed nodes is monitored, for objects approaching, within, or leaving the barrier area (Block 430) When objects are detected (Block 440), a determination is made about an appropriate action to take (Block 450).

In the case of a DPM node, its one or more sensors will determine the type of object and possibly detonate, applying lethal force to the object. In a networked scenario, higher-order information systems may determine that coordinated attack on the object is appropriate, and launch such an attack with weapons in close proximity to the barrier area. This monitor-determine-take appropriate action is continued (455) until the barrier is disabled, either explicitly or through the passage of time or by some other indicative method (Block 460).

At this point, while we have discussed and described my invention using some specific examples, those skilled in the art will recognize that my teachings are not so limited. More specifically, a variety of different sensor types, deployment methods and communications schemes are satisfactory for use with our inventive method(s). In addition, alternative lethal and non-lethal munitions components would work equally well with our dynamic barrier system. Accordingly, our invention should be only limited by the scope of the claims attached hereto.

What is claimed is:

1. A method for establishing and operating a dynamic barrier system comprising:

deploying into a barrier area a plurality of first projectiles, each-first projectile including a sensor and not containing any lethal or otherwise intentionally harmful payload, which first projectiles are deployed in a two dimensional array forming rows and columns, with alternating rows offset vertically by one column, such that the projectiles in each row align linearly with the projectiles in every other row of the array, and wherein the detection zone of the sensor within each projectile overlaps with the detection zone of the sensors of at least two other projectiles, which first projectiles are deployed by being fired from a barrel;

monitoring the barrier area using the sensors of the first projectiles;

detecting an object within the barrier area, which detection is enhanced by the overlapping detection zones;

deploying at least one second projectile into the barrier area by firing the second projectile from a barrel, the second projectile including a warhead and at least one sensor;

determining a type of object using the at least one sensor in the second projectile; and detonating the warhead in the second projectile.

2. The method of claim 1, wherein determining a type of the object includes differentiating between personnel and vehicles using the at least one sensor in the second projectile.

3. The method of claim 2, wherein the at least one sensor in the second projectile includes an E-field sensor and a B-field sensor.

4. The method of claim 3, wherein detonating the warhead includes detonating the warhead in a first manner if the object is determined to be personnel and detonating the warhead in a second manner if the object is determined to be a vehicle.

5. The method of claim 1, wherein deploying the at least one second projectile into the barrier includes deploying a plurality of second projectiles in the barrier area.

6. The method of claim 5, further comprising, after deploying the plurality of first projectiles, establishing a communication network among the sensors in the plurality of first projectiles.

7. The method of claim 1, wherein the sensor of the first projectile is at least one of an acoustic, magnetic, seismic, chemical and photonic sensor.

8. The method of claim 4, further comprising, before detonating the warhead, vertically orienting the warhead.

9. The method of claim 8, wherein the warhead includes a shaped charge surrounded by a scored housing.

10. The method of claim 4, wherein detonating the warhead in the second manner includes detonating the warhead when a signal of the B-field sensor begins to weaken.

11. A method for establishing and operating a dynamic barrier system, comprising:

deploying a plurality of projectiles, each projectile containing a warhead and at least one sensor, into a barrier area by firing the projectiles from a barrel, the projectiles being deployed in a two dimensional array forming rows and columns, with alternating rows offset vertically by one column, such that the projectiles in each row align linearly with the projectiles in every other row of the array, and wherein the detection zone of the sensor within each projectile overlaps with the detection zone of the sensor zone of at least two other projectiles; and monitoring the barrier area using the at least one sensor of each projectile to detect any object within the barrier area, whereby such detection is enhanced by the overlapping detection zones.

12. The method of claim 11, further comprising detecting an object within the barrier area and determining a type of object using the at least one sensor in each projectile.

13. The method of claim 12, further comprising detonation the warhead in at least one projectile.

14. The method of claim 11, further comprising automatically disabling the warhead after expiration of a pre-determined period of time.

* * * * *